US009291172B2

(12) United States Patent
Chun et al.

(10) Patent No.: US 9,291,172 B2
(45) Date of Patent: Mar. 22, 2016

(54) APPARATUS AND METHOD FOR GENERATING WAVE FUNCTIONAL PULSATILE MICROFLOWS BY APPLYING FOURIER COSINE SERIES AND HYDRAULIC HEAD DIFFERENCE

(71) Applicant: KOREA INSTITUTE OF SCIENCE AND TECHNOLOGY, Seoul (KR)

(72) Inventors: Myung-Suk Chun, Seoul (KR); Kwang Seok Kim, Guri-si (KR); Hyoung-Juhn Kim, Suwon-si (KR); Young Tae Byun, Guri-si (KR)

(73) Assignee: KOREA INSTITUTE OF SCIENCE AND TECHNOLOGY, Seoul (KR)

( * ) Notice: Subject to any disclaimer, the term of this patent is extended or adjusted under 35 U.S.C. 154(b) by 372 days.

(21) Appl. No.: 14/090,781

(22) Filed: Nov. 26, 2013

(65) Prior Publication Data

US 2014/0144513 A1 May 29, 2014

(30) Foreign Application Priority Data

Nov. 29, 2012 (KR) ..... 10-2012-0136660

(51) Int. Cl.
*F04B 17/00* (2006.01)
*F04F 7/00* (2006.01)
*F04D 11/00* (2006.01)

(52) U.S. Cl.
CPC . *F04F 7/00* (2013.01); *F04D 11/00* (2013.01); *Y10T 137/0318* (2015.04); *Y10T 137/85978* (2015.04)

(58) Field of Classification Search
CPC ..... F04F 7/00; F04F 7/02; F04F 11/00; Y10T 137/85978; Y10T 137/0318
USPC ..... 417/328, 329
See application file for complete search history.

(56) References Cited

U.S. PATENT DOCUMENTS 3,617,153 A * 11/1971 Mowry ..... F04F 7/00 417/241
4,085,544 A * 4/1978 Blake ..... A01G 27/005 185/4

(Continued)

FOREIGN PATENT DOCUMENTS

JP 2008-111347 A 5/2008
JP 2012-210067 A 10/2012

(Continued)

OTHER PUBLICATIONS

Kim, Dongshin et al., "A method for dynamic system characterization using hydraulic series resistance." Lab on a Chip 6.5 (2006): 639-644.

Melin, Jessica, et al., "Microfluidic large-scale integration: the evolution of design rules for biological automation." Annu. Rev. Biophys. Biomol. Struct. 36 (2007): 213-231.

*Primary Examiner* — Charles Freay
(74) *Attorney, Agent, or Firm* — NSIP Law

(57) ABSTRACT

An apparatus for generating pulsatile flows includes a liquid vessel capable of containing a liquid, a plurality of revolving mechanisms associated with each other, and a microchannel supplied with a liquid from the liquid vessel. As the plurality of revolving mechanisms rotate, a periodically changing pressure difference occurs between the liquid vessel and the microchannel, thereby implementing a pulsatile flow having a wave functional form in the microchannel. By applying the hydraulic head difference and controlling revolution of the revolving mechanisms based on Fourier cosine series, a minute and precise pulsatile flow of a wave functional form may be implemented by means of simple configuration and fabrication, which may not easily obtained by a conventional pump.

27 Claims, 13 Drawing Sheets

(56) References Cited

U.S. PATENT DOCUMENTS 4,990,062 A * 2/1991 Swank ..... F04B 1/20
417/211
5,044,901 A 9/1991 Fumero et al.
8,297,055 B2 * 10/2012 Ackman ..... F03B 17/00
417/329
2004/0146409 A1 7/2004 Lee et al.

FOREIGN PATENT DOCUMENTS

KR 10-2012-0054766 A 5/2012
KR 10-1272250 B1 6/2013

* cited by examiner

APPARATUS AND METHOD FOR GENERATING WAVE FUNCTIONAL PULSATILE MICROFLOWS BY APPLYING FOURIER COSINE SERIES AND HYDRAULIC HEAD DIFFERENCE

CROSS-REFERENCE TO RELATED APPLICATION

This application claims priority to Korean Patent Application No. 10-2012-0136660, filed on Nov. 29, 2012, and all the benefits accruing therefrom under 35 U.S.C. §119, the contents of which in its entirety are herein incorporated by reference.

BACKGROUND

1. Field

Embodiments relate to an apparatus and a method for generating pulsatile flows having a wave functional form, and more particularly, to an apparatus and a method for generating pulsatile flows, which rotates a liquid vessel at a constant angular velocity by means of a plurality of rotating disks operating in association with each other and implements revolution based on Fourier cosine series and a principle of hydraulic head difference associated with the Bernoulli concept in relation to a pressure difference, thereby generating a periodic pressure difference of a wave functional form by the change of height of a liquid surface.

2. Description of the Related Art

The pulsatile flow is a term in the field of fluid mechanics and refers to all kinds of flows having a periodic change with respect to a flow velocity. Most representatively, the pulsatile flow is a flow of blood in a blood vessel, caused by periodic shrinkage and release of the heart. In the engineering fields, most pumping devices except for a syringe pump or the like exhibit the pulsatile flow. In the field of microfluidics which gives a great influence on the development of next-generation bio-medical techniques such as an high-precision micro pump, the role of the pulsatile flow is greatly increased. But there are many limits in aspect of precise implementation, efficient operation, and manufacture costs. The flow of liquid may not be easily interrupted or controlled instantly due to the inertia of the fluid, different from electric current, even though the amount of liquid is small. A pumping device generating a pulsatile flow has been initially used for extracorporeal circulation of blood during a heart surgery. For example, Basiglio and Vergamo (Basiglio, R. F., Vergamo, L. P., U.S. Pat. No. 5,044,901, entitled "Pulsatile pump for extro-corporeal circulation", September, 1991) have invented a pulsatile pump for extracorporeal circulation.

Fourier cosine series is a technique for approximately expressing any even function given as a time periodic function using a linear combination of cosine functions which are representative periodic even functions. In this regard, Fourier sine series is used for approximating an odd function to a sine function, and Fourier series is also used for approximating a function other than an even function or an odd function to a cosine or sine function. Herein, the oscillation frequency of the sine or cosine function is given as an inverse number of integer multiple of pi. Meanwhile, when approximating a function other than a periodic function, Fourier transform is used, and in this case the oscillation frequency is a real number space.

The microfluidics deals with the fluid flowing through a microchannel formed in a microfluidic chip, and recently plays an important role in the bio-MEMS and power-MEMS.

In a microfluidic device, a pressure-driven device such as a pump is frequently used to maintain a normal fluid flow or apply a periodic/non-periodic velocity change. However, the pump has a very large size in comparison to the microfluidic chip, which disturbs miniaturization of a system. In addition, if precise flow control is required, the costs and components for a demanded pump are greatly increasing. Melin and Quake (Melin, J., Quake, S. R., "Microfluidic large-scale integration: The evolution of design rules for biological automation", Annu. Rev. Biophys. Biomol. Struct., 36, 213-31, 2007) have invented a method for embedding a micro pump in a microfluidic chip, but a complicated external pressurizing device is required to operate the embedded pump.

A square wave, which is a kind of the wave function, may be ideally obtained only at a very rapid response according to opening/closing of an electric current, like an electronic circuit or signal processing. It is practically very difficult to perfectly implement a square wave pulsatile flow in which fluids having two different flow rates change periodically or instantly. When a drug delivery matrix or a batch-type microreactor is implemented in a microfluidic chip, a pulsatile flow of a square wave form is needed. In most cases, expensive wave-controlling syringe pumps commercially available are used instead, but these have an obvious limit in implementing the square wave.

Kim et al. (Kim, D., Chester, N.C., Beebe, D. J., "A method for dynamic system characterization using hydraulic series resistance", Lab Chip, 6, 639-644, 2006) have attempted to implement a square wave pressure difference in a microfluidic channel by using a complicated device design including a sensor, a computer controller, a regulator or the like. However, due to the serious complexity of the device, there is a limit in accuracy, and for example, an actually implemented result deviates from a theoretical input value according to the size of the channel. In addition, in this device, only a forwarding type pulsatile flow may be implemented.

Lee et al. (Lee, Y. S., Oh, Y. S., Kuk, K., Kim, M. S., Shin, S. J., Shin, S. H., "Micro-pump driven by phase change of a fluid", US Patent Publication No. 2004/0146409, January, 2004) have invented a device for instantly increasing a flow rate supplied to a micro channel, by using a phase change of fluid by heat. However, the pulsatile flow generated in this way is also used for inducing a cascade-type flow and is not suitable for generating a back-and-forth standing type pulsatile flow.

SUMMARY

An aspect of the present disclosure is directed to providing a wave functional pulsatile flow, which may not be easily applied by an existing pump, to a device in the field of microfluidics or medical engineering based thereon, such as Lab-on-a-Chip and bio-MEMS. An aspect of the present disclosure may allow controlling a period and amplitude of pulsatile flow, implementing various pulsatile flows such as a square wave and a triangular wave, and implementing a forwarding type operation and a back-and-forth standing type operation.

The apparatus for generating pulsatile flows according to an embodiment may include: a first revolving mechanism configured to rotate based on a first rotating shaft located at a first height from a microchannel; a second revolving mechanism connected to the first revolving mechanism and configured to rotate based on a second rotating shaft located at a second height different from the first height; and a liquid vessel connected to the second revolving mechanism and configured to contain a liquid to be supplied to the microchannel. By using periodically changing pressure of the liquid applied to the microchannel when the first revolving mechanism and the second revolving mechanism are rotating, a pulsatile flow is generated in the microchannel by the liquid supplied from the liquid vessel.

The method for generating pulsatile flows according to an embodiment may include: rotating a first revolving mechanism based on a first rotating shaft located at a first height from a microchannel; rotating a second revolving mechanism, connected to the first revolving mechanism and a liquid vessel containing a liquid, based on a second rotating shaft located at a second height different from the first height; and supplying a liquid from the liquid vessel to the microchannel when the first revolving mechanism and the second revolving mechanism are rotating, thereby generating a pulsatile flow in the microchannel by using periodically changing pressure of the liquid supplied to the microchannel.

If the apparatus and method for generating pulsatile flows according to the embodiment of the present disclosure are used, various types of wave functional pulsatile flow such as a square wave, a triangular wave, a sawlike wave or the like, which may not be easily implemented by a conventional motor-driven method such as piston reciprocation, centrifugal method, gear turning method or the like, may be implemented.

In addition, the period and amplitude of pulsatile flow may be respectively controlled by adjusting an angular velocity of the rotating shaft and a radius of revolution of another rotating shaft through a plurality of assembly points included in the rotating disk. Further, a mean pressure difference of the pulsatile flow may be controlled by adjusting a height difference of the rotating shaft connected to a motor and the microchannel. Moreover, both a forwarding type and a back-and-forth standing type may be implemented.

Furthermore, since the apparatus for generating pulsatile flows has a simple configuration and a precise wave functional pulsatile flow may be implemented with a low production cost, the apparatus may be usefully utilized in the microfluidic field and other applications.

BRIEF DESCRIPTION OF THE DRAWINGS

The above and other aspects, features and advantages of the disclosed exemplary embodiments will be more apparent from the following detailed description taken in conjunction with the accompanying drawings in which.

DETAILED DESCRIPTION

Figure 1:
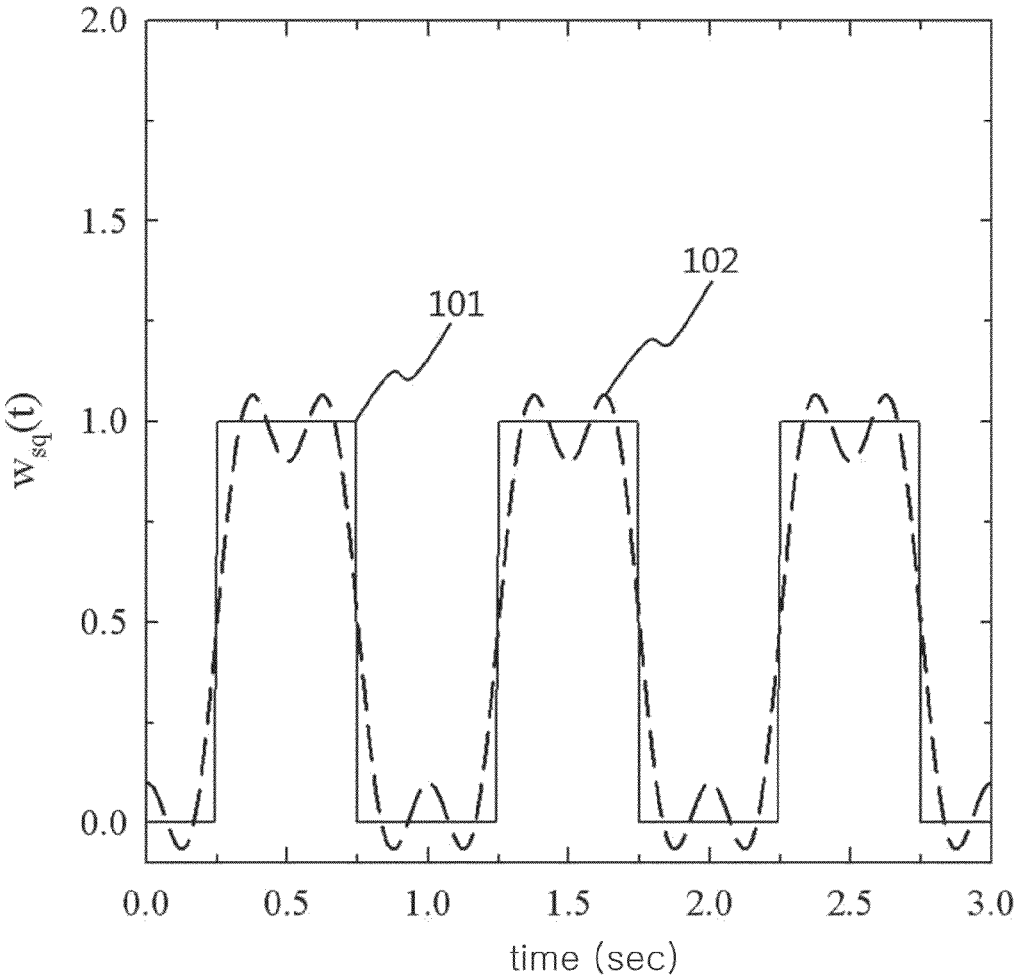
FIG. 1 is a graph showing an approximate square wave obtained with Fourier series according to an embodiment in comparison with a square wave exactly defined.

Hereinafter, embodiments of the present disclosure will be described in detail with reference to the accompanying drawings.

By the apparatus and method for generating pulsatile flows according to the embodiments, a pulsatile microflow with a wave function may be generated. The apparatus and method for generating pulsatile flows use implementation of revolution based on Fourier cosine series and a principle of hydraulic head difference relevant to the Bernoulli concept about a pressure difference. Hereinafter, the principle of Fourier cosine series used by the apparatus and method for generating pulsatile flows will be described in detail.

First, a method for implementing a square wave by Fourier cosine series according to an embodiment will be described.

First of all, an equation expressing an arbitrary time periodic function w(t) with Fourier cosine series should be obtained. Herein, an even function w(t) having a period T in time t may be expressed as an infinite series of Fourier cosine like Equation 1 below. In Equation 1 below, $A_n$ represents an amplitude or Fourier cosine coefficient, n represents an integer, π represents pi, and nπ represents an angular velocity in the dimension of rad/sec.

$$w(t) = \sum_{n=0}^{\infty} A_n \cos\left(\frac{n\pi}{T} t\right) \qquad \text{Equation 1}$$

In order to determine the Fourier cosine coefficient $A_n$ of Equation 1, $w_{sq}(t)$ is defined as in Equation 2 and Equation 3 below by using a square wave as an elementary form.

$$w_{sq}(t) = \begin{cases} 0 & \text{for } 0 \le t < \frac{T}{4},\ \frac{3T}{4} \le t < T \\ 1 & \text{for } \frac{T}{4} \le t < \frac{3T}{4} \end{cases} \qquad \text{Equation 2}$$

$$w_{sq}(t) = w_{sq}(t - T) \qquad \text{Equation 3}$$

Equation 3 represents that $w_{sq}(t)$ has a period of T. If a Fourier cosine coefficient is determined by using orthogonality of cosine function and applying one-cycled integration (0<t<T), the square wave of this embodiment may be obtained as Equation 4 below.

$$w_{sq}(t) = \frac{1}{2} - \frac{2}{\pi}\cos\left(\frac{2\pi}{T}t\right) + \frac{2}{3\pi}\cos\left(\frac{6\pi}{T}t\right) - \frac{2}{5\pi}\cos\left(\frac{10\pi}{T}t\right) + \ldots \approx \frac{1}{2} + \frac{2}{\pi}\sum_{n=1}^{\infty}\frac{(-1)^n}{(2n-1)}\cos\left(\frac{(4n-2)\pi}{T}t\right) \quad \text{Equation 4}$$

If Equation 1 is compared with Equation 4, the Fourier cosine coefficient $A_n$ may be expressed as Equation 5 below.

$$A_0 = \frac{1}{2},\ A_n = \frac{2}{\pi}\frac{(-1)^n}{(2n-1)} \quad \text{Equation 5}$$

Due to the characteristics of an infinite series approximation, as n increases, the amplitude $A_n$ decreases in an inverse proportion. Therefore, in some embodiments, the terms higher than n=2 or n=3 of the Fourier cosine coefficient $A_n$ may be neglected.

The apparatus for generating pulsatile flows according to embodiments may be implemented to include a plurality of revolving mechanisms which rotate at different speeds. Herein, in the Equation 4, n corresponds to the number of revolving mechanisms. In an embodiment, it may be determined as n=2 for the convenience of production, without being limited thereto.

In case of n=2, the Fourier cosine coefficient calculated through Equation 5 may be expressed like Equation 6 below by rounding off the numbers to the nearest hundredths.

$$w_{sq}(t) = 0.5 - 0.6\cos\left(\frac{2\pi}{T}t\right) + 0.2\cos\left(\frac{6\pi}{T}t\right) \quad \text{Equation 6}$$

FIG. 1 is a graph showing an approximate square wave obtained with Fourier series according to an embodiment in comparison to a square wave exactly defined.)

Referring to FIG. 1, a solid line 101 shows $w_{sq}(t)$ exactly defined by Equation 2 above in a mathematical way. Meanwhile, a dashed curve 102 shows an approximate square wave obtained with Fourier series according to an embodiment, which is $w_{sq}(t)$ defined by Equation 6. As shown in FIG. 1, the result of Equation 6 approximately expresses the square wave of Equation 2. Both plots 101, 102 depicted in FIG. 1 are dimensionless, and the function has amplitude of 1, a mean value of 0.5, and a period of 1. Here, if the unit of time t is defined as a second (sec), the unit of oscillation frequency will be Hz.

If a conversion factor H (mbar or $cmH_2O$) is used to convert the dimensionless amplitude into a pressure difference in Equation 6, a relation of Equation 7 below in relation to a pressure difference $\Delta P_{sq}(t)$ is established. The square wave pulsatile flow given herein corresponds to a forwarding type pulsatile flow.

$$\Delta p_{sq}(t) = Hw_{sq}(t) = 0.5H - 0.6H\cos\left(\frac{2\pi}{T}t\right) + 0.2H\cos\left(\frac{6\pi}{T}t\right) \quad \text{Equation 7}$$

In Equation 7, the conversion factor H may be determined by using a mean pressure difference to be obtained. Since the term corresponding to a mean pressure difference in Equation 7 is 0.5H, the conversion factor H will be twice of the mean pressure difference. If this is applied to the apparatus for generating pulsatile flows according to embodiments, the conversion factor H may be determined based on the kinds of liquids. For example, since the head difference of 1 cm of water corresponds to a pressure difference of 0.98 mbar, in order to obtain a square wave pulsatile flow with forwarding type for a mean pressure difference of 10 mbar, the apparatus should be designed to have a mean head difference of 10.2 cm, and in Equation 7, H becomes 20 mbar (or 20.4 $cmH_2O$).

Next, a method for implementing a triangular wave by Fourier cosine series according to another embodiment will be described.

Similar to the method for obtaining a square wave, a triangular wave pulsatile flow with forwarding type may be obtained through the following procedure. First, $w_{sq}(t)$ is defined like Equation 8 and Equation 9 below as an elementary form of a triangular wave having a period T.

$$w_{tr}(t) = \begin{cases} 1 - \frac{2}{T}t & \text{for } 0 \le t < \frac{T}{2} \\ \frac{2}{T}t - 1 & \text{for } \frac{T}{2} \le t < T \end{cases} \quad \text{Equation 8}$$

$$w_{tr}(t) = w_{tr}(t - T) \quad \text{Equation 9}$$

If the same Fourier cosine series and simplifying method as being used to obtain Equation 6 from 4 are applied to Equation 8, Equation 10 below may be obtained.

$$w_{tr}(t) = \frac{1}{2} + \frac{4}{\pi^2}\cos\left(\frac{2\pi}{T}t\right) + \frac{4}{9\pi^2}\cos\left(\frac{6\pi}{T}t\right) + \frac{4}{25\pi^2}\cos\left(\frac{10\pi}{T}t\right) + \ldots \approx 0.5 + 0.4\cos\left(\frac{2\pi}{T}t\right) + 0.05\cos\left(\frac{6\pi}{T}t\right) \quad \text{Equation 10}$$

Figure 2:
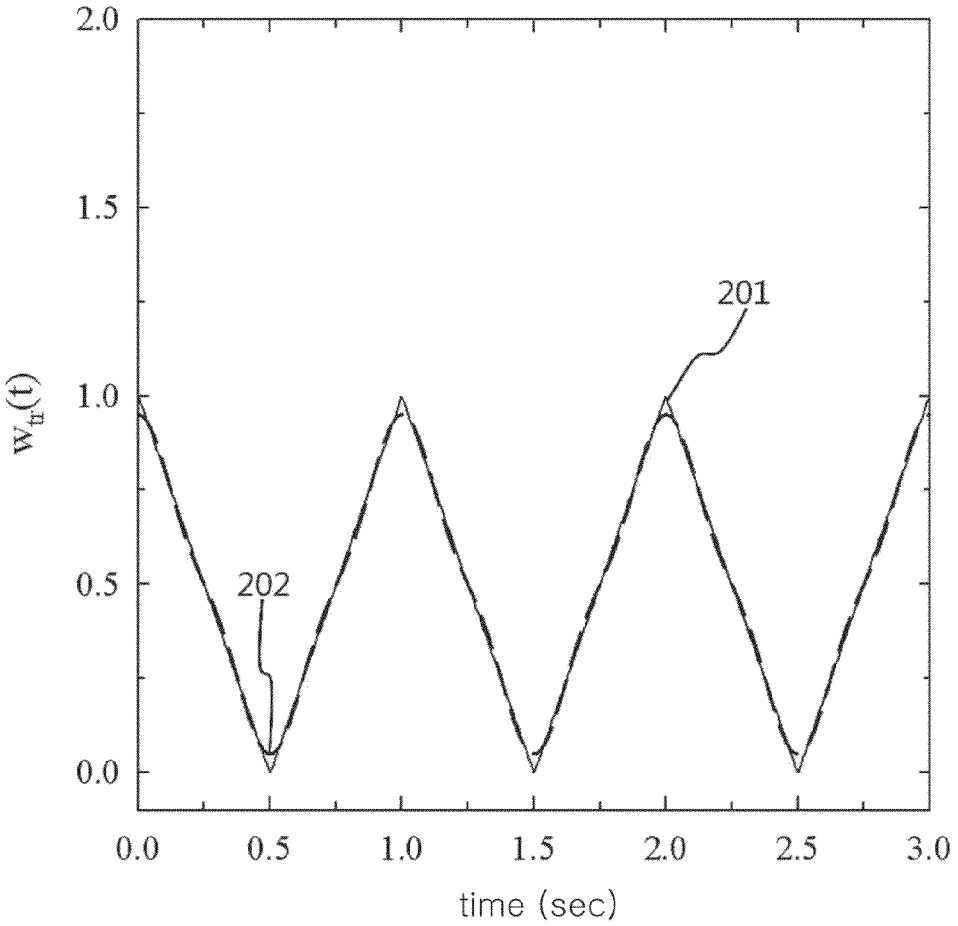
FIG. 2 is a graph showing an approximate triangular wave obtained with Fourier series according to an embodiment in comparison with a triangular wave exactly defined.

FIG. 2 is a graph showing an approximate triangular wave obtained with Fourier series according to an embodiment in comparison to a triangular wave exactly defined.

Referring to FIG. 2, a solid line 201 represents $w_{sq}(t)$ exactly defined by Equation 8 above in a mathematical way. Meanwhile, a dashed curve 202 shows an approximate triangular wave obtained with Fourier series according to the embodiment, which is $w_{sq}(t)$ defined by Equation 10. As shown in FIG. 2, Equation 10 is almost identical to Equation 8, except for a very minute difference occurring at a point corresponding to an apex of a triangle.

If a conversion factor H is applied to Equation 10, similar to Equation 7 above, Equation 11 below may be obtained.

$$\Delta p_{tr}(t) = Hw_{tr}(t) = 0.5H + 0.4H\cos\left(\frac{2\pi}{T}t\right) + 0.5H\cos\left(\frac{6\pi}{T}t\right) \quad \text{Equation 11}$$

Figure 3:
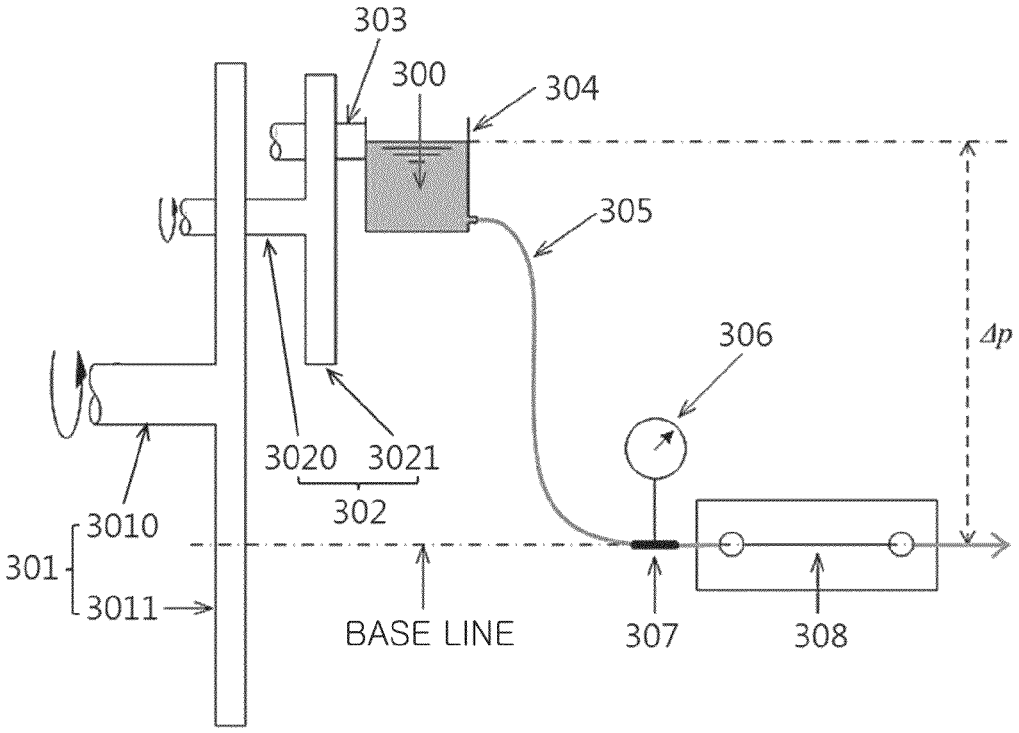
FIG. 3 is a schematic diagram showing an apparatus for generating pulsatile flows according to an embodiment.

FIG. 3 is a schematic diagram showing an apparatus for generating pulsatile flows according to an embodiment, which may generate pulsatile flows by using a pressure difference of liquid based on Fourier series as described above.

Referring to FIG. 3, the apparatus for generating pulsatile flows according to this embodiment may include a plurality of revolving mechanisms 301, 302, a liquid vessel 304 and a microchannel 308. In the apparatus depicted in FIG. 3, a height difference between a base line where the microchannel 308 is located and a surface of a liquid 300 contained in the liquid vessel 304 is a head difference, corresponding to a pressure difference $\Delta p$.

In an embodiment, the apparatus for generating pulsatile flows may include a first revolving mechanism 301 and a second revolving mechanism 302. The first revolving mechanism 301 may include a rotating shaft 3010 and a rotating disk 3011 perpendicularly coupled thereto. The rotating shaft 3010 is coupled to a motor (not shown), and the rotating shaft 3010 may rotate according to the revolution of the motor. The rotating shaft 3010 may be located at a first height from the base line. As used herein, the height of the rotating shaft 3010 is intended to point out a distance from the base line to the center of the rotating shaft 3010 along the direction of gravity, and this definition is also applied to other components described later.

The second revolving mechanism 302 may include a rotating shaft 3020 and a rotating disk 3021 perpendicularly coupled thereto. The rotating shaft 3020 of the second revolving mechanism 302 is coupled to the rotating disk 3011 of the first revolving mechanism 301, and the center of the rotating shaft 3020 may be located at a second height from the base line, where the second height being different from the first height. A bearing (not shown) may be located between the rotating disk 3011 and the rotating shaft 3020, so that the rotating shaft 3020 may rotate independently regardless of the revolution of the rotating disk 3011. Herein, the rotating shaft 3020 is associated with the rotating shaft 3010 through a rubber belt (not shown) or the like, so that the rotating shaft 3020 may rotate at an angular velocity which has a predetermined ratio to the angular velocity of the rotating shaft 3010.

In the embodiment depicted in FIG. 3, n=2 in Equation 4 above, which means that the apparatus includes two revolving mechanisms 301, 302. However, in another embodiment, the apparatus for generating pulsatile flows may include more revolving mechanisms. For example, the apparatus for generating pulsatile flows may further include a third revolving mechanism (not shown) connected between the second revolving mechanism 302 and the liquid vessel 304.

The liquid vessel 304 is configured to contain liquid (for example, water) for generating a pulsatile flow. The liquid vessel 304 may be coupled to the rotating disk 3021 of the second revolving mechanism 302 through a liquid vessel connector 303. A bearing (not shown) may be located between the liquid vessel connector 303 and the rotating disk 3021, so that the liquid vessel 304 may always maintain a vertically upright state regardless of the revolution of the rotating disk 3021. In addition, the liquid vessel 304 may be connected to the microchannel 308 through a tubing 305, and a pressure gauge 306 is provided at the tubing 305 by means of a pressure gauge connection tee 307. In an embodiment, the cross-sectional area of the tubing 305 and the connection tee 307 may be higher than the cross-sectional area of the microchannel 308 in order to eliminate or reduce a pressure loss caused by inertia of the liquid or friction.

In this embodiment, a constant amount of liquid supplied from the liquid vessel 304 may successively pass through the microchannel 308, and a flow rate discharging from the liquid vessel 304 is identical to the flow rate passing through the cross-section of the microchannel 308. By doing so, a height change of liquid surface with time progress can be related to a width or breadth of the liquid vessel 304. In other words, as the first and second revolving mechanisms 301, 302 rotate, a height difference between the surface of the liquid 300 contained in the liquid vessel 304 and the base line where the microchannel 308 is located changes periodically. Due to the periodically changing height of the surface of the liquid 300, a periodic pressure difference is applied to the microchannel 308, and accordingly a pulsatile flow of liquid is implemented in the microchannel 308.

In an embodiment, a pressure applied from the liquid vessel 304 to the microchannel 308 may be measured by using a pressure gauge 306. For example, the pressure gauge 306 may be connected to the connection tee 307.

Figure 4:
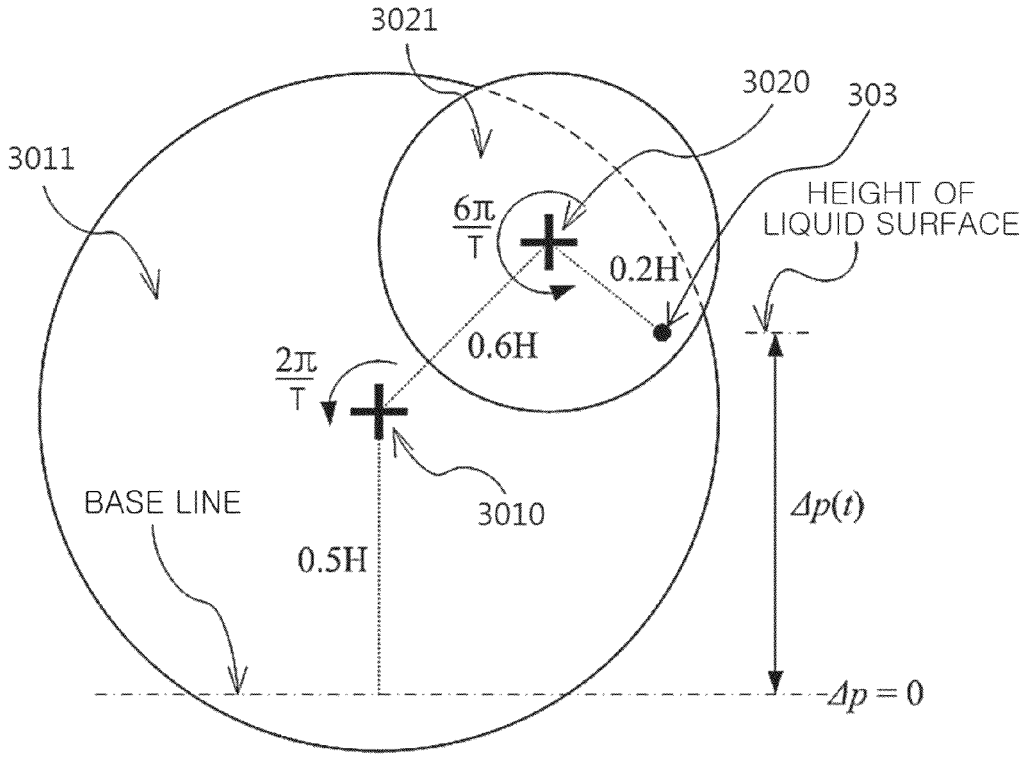
FIG. 4 is a front view showing first and second revolving mechanisms for obtaining a square wave pulsatile flow in the apparatus for generating pulsatile flows according to an embodiment.

FIG. 4 is a front view showing first and second revolving mechanisms for obtaining a square wave pulsatile flow in the apparatus for generating pulsatile flows according to an embodiment.

Referring to FIG. 4, the height from the base line where the microchannel is located to the rotating shaft 3010 of the first revolving mechanism may be determined as Fourier cosine coefficient 0.5H in the first term of Equation 7 which corresponds to the mean pressure difference. In addition, the distance between the rotating shaft 3010 of the first revolving mechanism and the rotating shaft 3020 of the second revolving mechanism may be determined as Fourier cosine coefficient 0.6H in the second term of Equation 7. Further, the distance from the rotating shaft 3020 of the second revolving mechanism to the liquid vessel connector 303 may be determined as Fourier cosine coefficient 0.2H in the third term of Equation 7. In other words, the locations of the rotating shaft 3010, the rotating shaft 3020 and the liquid vessel may be adjusted so that a ratio of the above three distances becomes 5:6:2.

In addition, the angular velocity of the rotating shaft 3010 of the first revolving mechanism may be $2\pi/T$ corresponding to the angular velocity in the second term of Equation 7. Moreover, the angular velocity of the rotating shaft 3020 of the second revolving mechanism may be $67\pi/T$ corresponding to the angular velocity in the third term of Equation 7. Therefore, the angular velocity of the rotating shaft 3020 should be maintained as three times of the angular velocity of the rotating shaft 3010. However, the angular velocities of the rotating shafts 3010, 3020 may be different depending on the period of a square wave to be obtained. For example, in order to double the period of the square wave, the oscillation frequency (namely, angular velocity of the rotating shafts 3010, 3020) of the cosine function may be halved.

Figure 5:
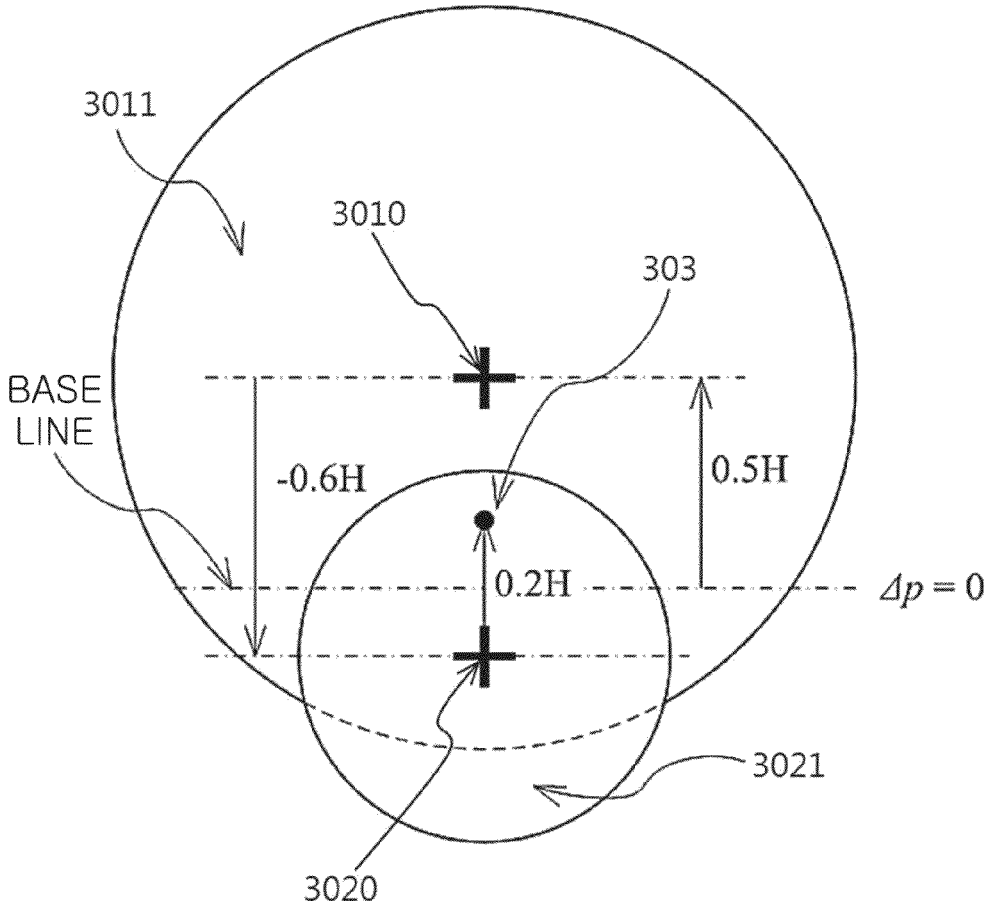
FIG. 5 is a front view showing an initial position of the first and second revolving mechanisms for obtaining a square wave pulsatile flow in the apparatus for generating pulsatile flows according to an embodiment.

FIG. 5 is a front view showing an initial position of the first and second revolving mechanisms for obtaining a square wave pulsatile flow in the apparatus for generating pulsatile flows according to an embodiment.

In Equation 7, in the case of t=0, the pressure difference is 0.5H−0.6H+0.2H=0.1H. To set this, as shown in FIG. 5, the rotating shaft 3010 of the first revolving mechanism may be located vertically higher from the base line by 0.5H (+0.5H), the rotating shaft 3020 of the second revolving mechanism may be located vertically lower from the rotating shaft 3010 of the first revolving mechanism (−0.6H), and the liquid vessel 304 may be located so that the liquid vessel connector 303 is located vertically higher from the rotating shaft 3020 of the second revolving mechanism (+0.2H).

As the rotating shaft 3010 and the rotating shaft 3020 rotate respectively at the positions described above, the height from the base line to the surface of the liquid contained in the liquid vessel periodically changes. As a result, the pressure difference between the surface of the liquid and the microchannel located at the base line changes in a form of a square wave pulsatile flow calculated by Equation 7, and a square wave pulsatile flow may be implemented in the microchannel by the liquid flowing from the liquid vessel into the microchannel.

Figure 6:
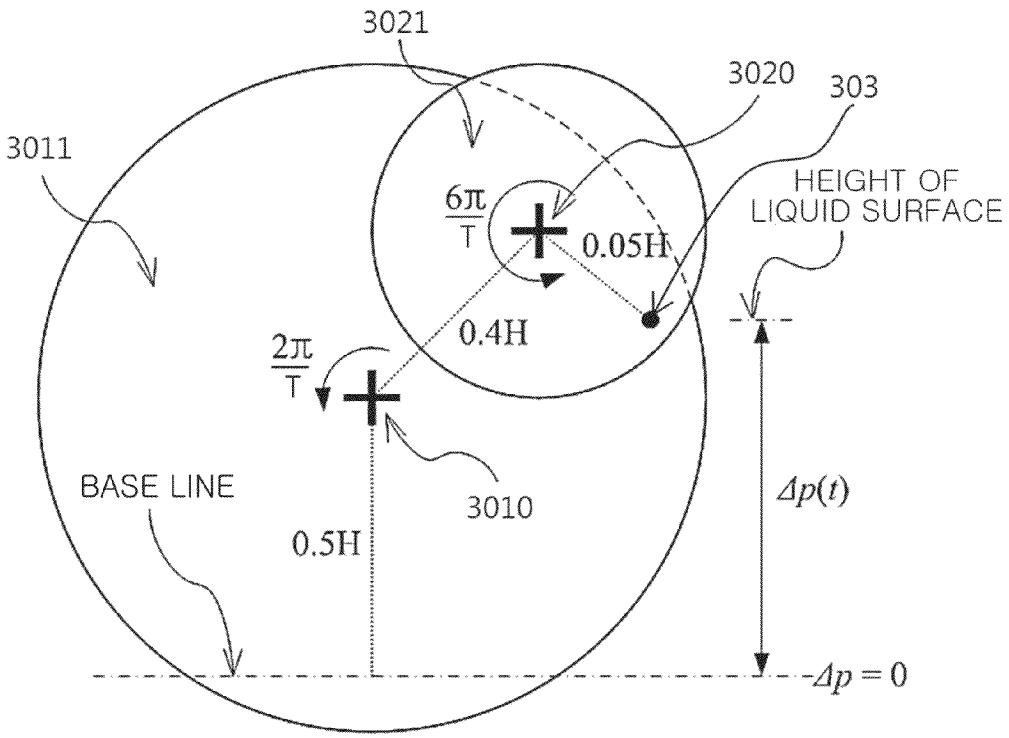
FIG. 6 is a front view showing first and second revolving mechanisms for obtaining a triangular wave pulsatile flow in the apparatus for generating pulsatile flows according to an embodiment.

FIG. 6 is a front view showing first and second revolving mechanisms for obtaining a triangular wave pulsatile flow in the apparatus for generating pulsatile flows according to an embodiment.

Referring to FIG. 6, the height from the base line where the microchannel is located to the rotating shaft 3010 of the first revolving mechanism may be determined as Fourier cosine coefficient 0.5H in the first term of Equation 11 which corresponds to a mean pressure difference. In addition, the distance between the rotating shaft 3010 of the first revolving mechanism and the rotating shaft 3020 of the second revolving mechanism may be determined as Fourier cosine coefficient 0.4H in the second term of Equation 11. Further, the distance from the rotating shaft 3020 of the second revolving mechanism to the liquid vessel connector 303 may be determined as Fourier cosine coefficient 0.05H in the third term of Equation 11. In other words, locations of the rotating shaft 3010, the rotating shaft 3020, and the liquid vessel may be adjusted so that a ratio of three distances described above becomes 10:8:1.

Similar to the implementation of the square wave pulsatile flow described above with references to FIGS. 4 and 5, in the embodiment depicted in FIG. 6, the angular velocity of the rotating shaft 3020 may also be maintained as three times of the angular velocity of the rotating shaft 3010.

Figure 7:
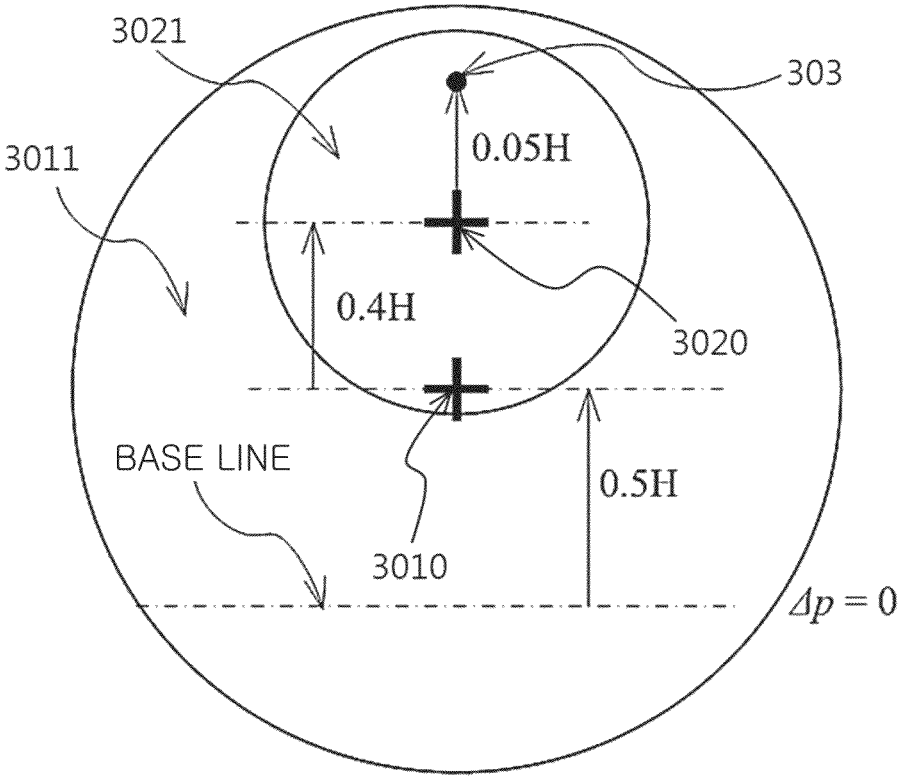
FIG. 7 is a front view showing an initial position of the first and second revolving mechanisms for obtaining a triangular wave pulsatile flow in the apparatus for generating pulsatile flows according to an embodiment.

FIG. 7 is a front view showing an initial position of the first and second revolving mechanisms for obtaining a triangular wave pulsatile flow in the apparatus for generating pulsatile flows according to an embodiment.

In Equation 11, in the case of t=0, the pressure difference is 0.5H+0.4H+0.05H=0.95H. To set this, as shown in FIG. 7, the rotating shaft 3010 of the first revolving mechanism may be located higher from the base line by 0.5H (+0.5H), the rotating shaft 3020 of the second revolving mechanism may be located vertically higher from the rotating shaft 3010 of the first revolving mechanism (+0.4H), and the liquid vessel 304 may be located so that the liquid vessel connector 303 is located vertically higher from the rotating shaft 3020 of the second revolving mechanism (+0.05H).

As the rotating shaft 3010 and the rotating shaft 3020 rotate respectively at the positions described above, the height from the base line to the surface of the liquid contained in the liquid vessel periodically changes. As a result, the pressure difference between the surface of the liquid and the microchannel located at the base line changes in a form of a triangular wave pulsatile flow calculated by Equation 11, and a triangular wave pulsatile flow may be implemented in the microchannel by the liquid flowing from the liquid vessel into the microchannel.

Figure 8:
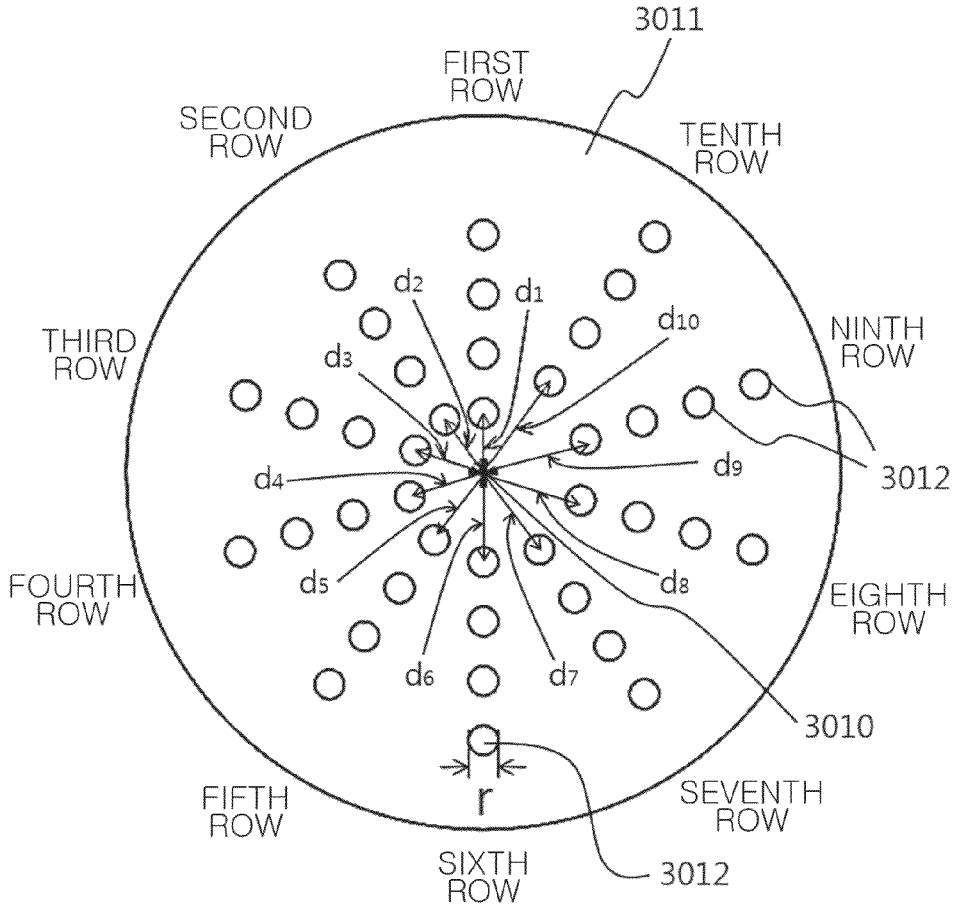
FIG. 8 is a front view showing a rotating disk of the first revolving mechanism employed in the apparatus for generating pulsatile flows according to an embodiment.

FIG. 8 is a front view showing a rotating disk of the first revolving mechanism employed in the apparatus for generating pulsatile flows according to an embodiment.

Referring to FIG. 8, the first revolving mechanism may include a plurality of assembly points 3012 formed at the rotating disk 3011. Each assembly point 3012 may be a hole formed through the rotating disk 3011. The value of Fourier cosine coefficient given by Equation 7 or 11 may be different depending on operation conditions, and the distance between the rotating shaft of the first revolving mechanism and the rotating shaft of the second revolving mechanism may be adjusted by coupling the rotating shaft of the second revolving mechanism to any one of the plurality of assembly points 3012.

In an embodiment, the plurality of assembly points 3012 may form at least one row of the assembly points 3012 arranged in a direction from the center of the rotating disk 3011 toward a periphery of the rotating disk 3011. In addition, the row of the assembly points 3012 may be formed in plural. For example, forty assembly points 3012 may form ten rows from a first row to a tenth row, where each row has four assembly points 3012. In order to freely adjust the coupling location of the second revolving mechanism, the rows may be located at different distances from the rotating shaft 3010.

For example, a distance $d_1$ from the center of an assembly point 3012 which is nearest to the rotating shaft 3010 in the first row to the center of the rotating shaft 3010 may be about 10 mm, and a distance $d_2$ from the center of an assembly point 3012 nearest to the rotating shaft 3010 in the second row to the center of the rotating shaft 3010 may be about 11 mm As the row number increases, the corresponding distances $d_1$ to $d_{10}$ may increase by 1 mm each. In this case, a distance $d_{10}$ from the center of an assembly point 3012 nearest to the rotating shaft 3010 in the tenth row to the center of the rotating shaft 3010 may be about 19 mm In addition, an interval between adjacent assembly points 3012 in the same row may be about 10 mm, and a diameter r of each assembly point 3012 may be about 5 mm.

By connecting the rotating shaft 3020 (FIG. 4 or 6) of the second revolving mechanism to any one of the assembly points 3012 arranged as described above, the distance 0.6H between the rotating shaft 3010 of the first revolving mechanism and the rotating shaft 3020 of the second revolving mechanism based on Equation 7, or the distance 0.4H between the rotating shaft 3010 of the first revolving mechanism and the rotating shaft 3020 of the second revolving mechanism based on Equation 11 may be implemented with the degree of precision of 1 mm For example, in order to locate the rotating shaft of the second revolving mechanism at a position spaced apart from the rotating shaft 3010 of the rotating disk 3011 by 23 mm, the rotating shaft 3020 of the second revolving mechanism may be interposed into the second assembly point 3012 of the fourth row.

However, the arrangement of the rotating disk 3011 and the assembly point 3012 described above with reference to FIG. 8 is just an example, and the radius of the rotating disk 3011 and the number and arrangement of assembly points 3012 may be determined differently depending on the range of a desired hydraulic head difference. In addition, even though FIG. 8 shows the rotating disk 3011 of the first revolving mechanism, the configuration depicted in FIG. 8 may also be identically applied to the second revolving mechanism or a rotating disk of additional revolving mechanism. The radius of the rotating disk 3021 (FIG. 4 or 6) of the second revolving mechanism and the number of assembly points formed therein may be larger or smaller than those depicted in FIG. 8. For example, since the ratio of Fourier cosine coefficients in the second and third terms of Equation 7 is $A_1:A_2=3:1$, the radius of the rotating disk 3021 of the second revolving mechanism may be ⅓ of the radius of the rotating disk 3011 of the radius of the first revolving mechanism based thereon.

Figure 9:
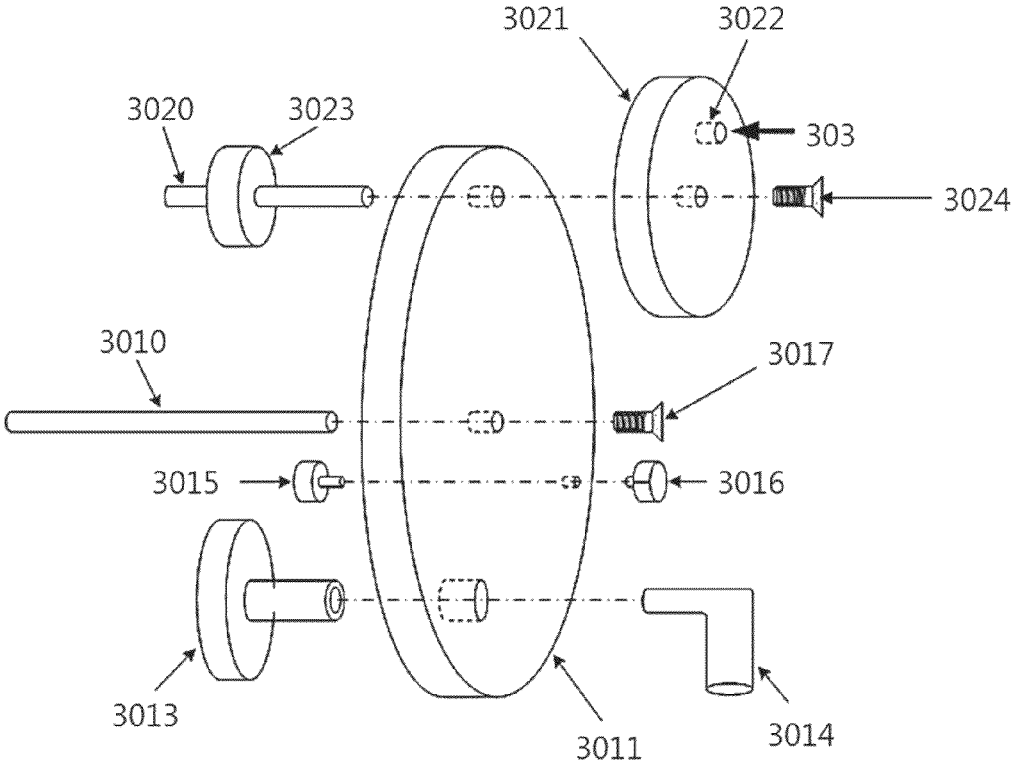
FIG. 9 is an exploded perspective view showing a first revolving mechanism, a second revolving mechanism and relevant members of the apparatus for generating pulsatile flows according to another embodiment.

FIG. 9 is an exploded perspective view showing a first revolving mechanism, a second revolving mechanism and relevant members of the apparatus for generating pulsatile flows according to another embodiment.

Referring to FIG. 9, the rotating shaft 3010 of the first revolving mechanism has a diameter in the range of 5 to 10 mm, and one end of the rotating shaft 3010 may be fixed to the center of the rotating disk 3011 by using a screw 3017. The other end of the rotating shaft 3010 may be coupled to a driving motor (not shown). The second revolving mechanism may include a disc 3023 coupled to the rotating shaft 3020. One end of the rotating shaft 3020 passes through one of the assembly points of the rotating disk 3011 of the first revolving mechanism and may be fixed to the rotating disk 3021 of the second revolving mechanism by a screw 3024. An assembly point 3022 may be formed at the rotating disk 3021 so that the liquid vessel is coupled thereto.

The balance weight disc 3013 may be coupled to a balance weight 3014 through any one of the assembly points of the rotating disk 3011. In addition, the constant tension unit 3015 may be coupled to the constant tension unit stopper 3016 through any one of the assembly points of the rotating disk 311. The balance weight disc 3013 and the constant tension unit 315 may be located at a side opposite to the rotating disk 3012 on the rotating disk 3011.

The balance weight 3014 and the balance weight disc 3013 may be installed so that the center of weight of components connected to the rotating disk 3011 is located at the rotating shaft 3010. The sum of weights of the balance weight 3014 and the balance weight disc 3013 may be greater than the sum of weights of the rotating disk 3021, the rotating shaft 3020 and the liquid vessel 304. For example, the sum of weights of the balance weight 3014 and the balance weight disc 3013 may be at least three times of the sum of weights of the constant tension unit 3015, the rubber belt 3018, the rotating shaft 3020, the rotating disk 3021 and the liquid vessel 304 containing the liquid 300. The balance weight 3014 configured as above is always directed downwards regardless of the revolution of the rotating disk 3011. As a result, the balance weight disc 3013 connected to the balance weight 3014 rotates with respect to the rotating disk 3011. The relative revolution speed of the balance weight disc 3013 is equal to the revolution speed of the rotating disk 3011, with an opposite direction.

In an embodiment, the disc 3023 of the second revolving mechanism closely adhered to the rear side of the rotating disk 3011 (namely, the surface opposite to the rotating disk 3021), the balance weight disc 3013 and the constant tension unit 3015 may all have the same width.

In addition, in an embodiment, the radius of the balance weight disc 3013 may be three times of the radius of the disc 3023. Moreover, in an embodiment, the radius of the constant tension unit 3015 may be equal or similar to the radius of the disc 3023 of the second revolving mechanism.

Figure 10A:
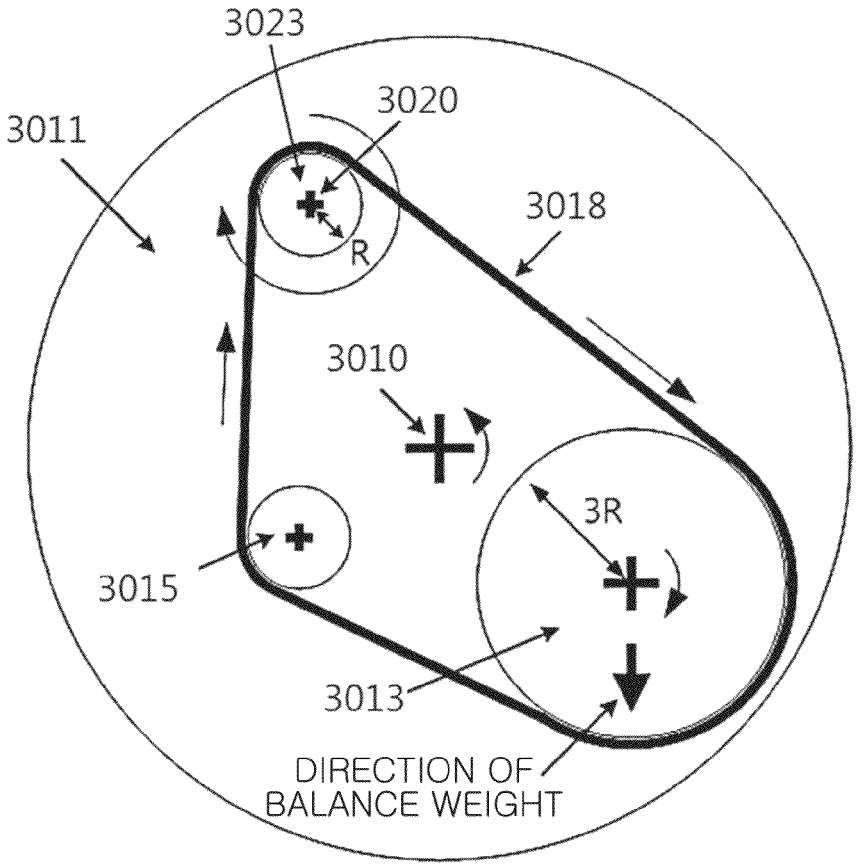
FIG. 10*a* is a rear view showing the first and second revolving mechanisms employed in the apparatus for generating pulsatile flows according to an embodiment.

FIG. 10*a* is a rear view showing the first and second revolving mechanisms employed in the apparatus for generating pulsatile flows according to an embodiment.

FIG. 10*a* depicts that the disc 3023 of the second revolving mechanism, the balance weight disc 3013, and the constant tension unit 3015 are all coupled to the rotating disk 3011. The disc 3023, the balance weight disc 3013, and the constant tension unit 3015 are connected to each other by the rubber belt 3018. Since the balance weight is always directed downwards regardless of the revolution of the rotating disk 3011, the angular velocity of the balance weight disc 3013 is equal to the angular velocity of the rotating disk 3011. In an embodiment, a ratio of radius between the balance weight disc 3013 and the rotating shaft 3020 is 3:1. As a result, one revolution of the balance weight disc 3013 results in three revolution of the disc 3023 or the rotating shaft 3020 connected through the rubber belt 3018 rotates three times. Therefore, the ratio of 1:3 of angular velocity between the first revolving mechanism and the second revolving mechanism determined based on Equations 7 and 11 may be implemented.

The constant tension unit 3015 plays a role to keep the tension of the rubber belt 3018 constantly so that the balance weight disc 3013 and the disc 3023 do not idle with each other. The location of the constant tension unit 3015 may be suitably determined according to the locations of the balance weight disc 3013 and the rotating shaft 3020, without being limited to the locations depicted in FIG. 10*a*.

Figure 10B:
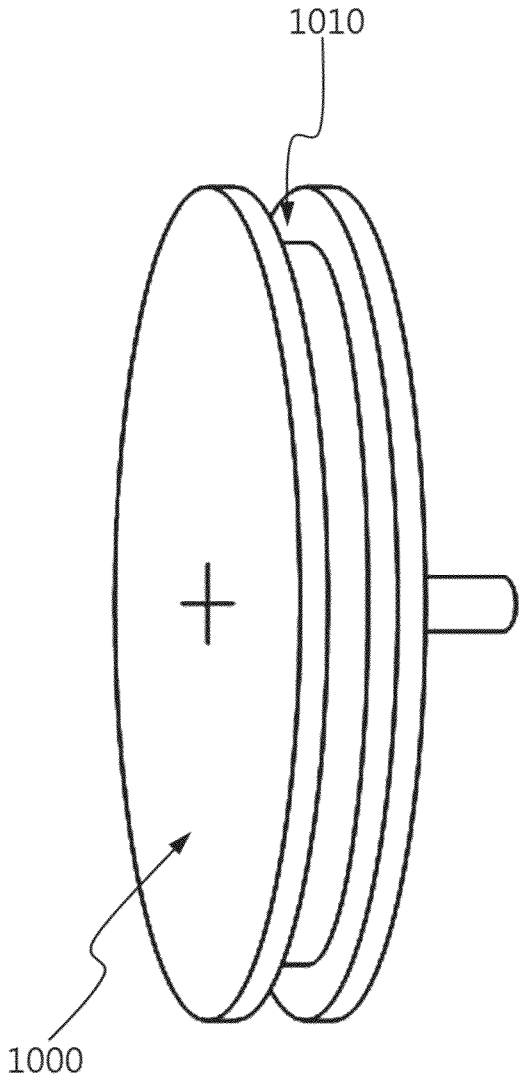
FIG. 10*b* is a perspective view showing a groove formed in a side of a disc of the second revolving mechanism, a balance weight disc or a constant tension unit.

FIG. 10*b* is a perspective view showing a groove formed in a side of the disc 3023 of the second revolving mechanism, the balance weight disc 3013 or the constant tension unit 3015.

Referring to FIG. 10*b*, the disc-shaped member 1000 may be any one of the disc 3023 of the second revolving mechanism, the balance weight disc 3013, and the constant tension unit 3015 described above with reference to FIG. 9. A groove 1010 is formed in a side of the disc-shaped member 1000, and the groove 1010 is connected to the rubber belt 3018 described above with reference to FIG. 10*a* and plays a role to prevent deviating the rubber belt 3018 from the disc-shaped member 1000. In addition, in an embodiment, the groove 1010 may have a depth identical to the thickness of the rubber belt 3018 to which the groove 1010 is to be coupled.

Figure 11:
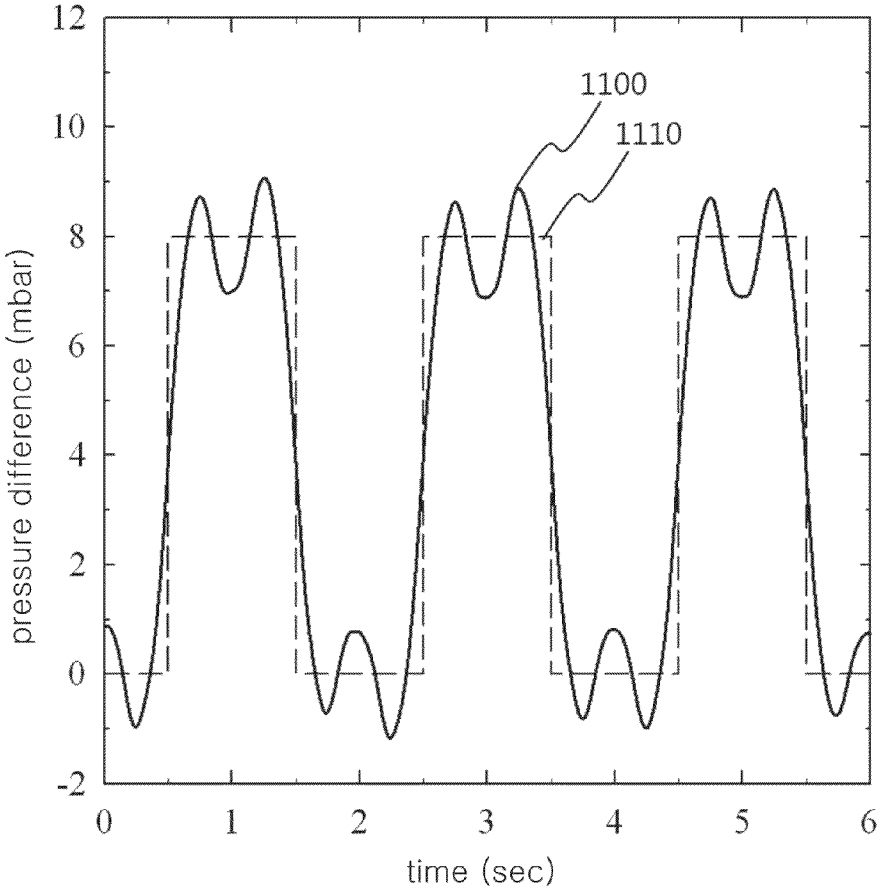
FIG. 11 is a graph showing a pressure change in a microchannel as time passes, in which a square wave pulsatile flow with forwarding type is implemented by the apparatus for generating pulsatile flows according to an embodiment.

FIG. 11 is a graph showing a pressure change in a microchannel as time passes, in which a square wave pulsatile flow with forwarding type is implemented by the apparatus for generating pulsatile flows according to an embodiment.

The result depicted in FIG. 11 was measured using a microchannel which is made of polymer, polydimethylsiloxane (PDMS), and has a width of about 50 μm, a height of about 250 μm and a length of about 3 cm. The location of the microchannel becomes a height of the base line of FIG. 4. The difference between the base line and the rotating shaft of the first revolving mechanism, which determines the mean pressure difference, was about 4 cm. Based on Equation 7, the distance between the rotating shaft of the first revolving mechanism and the rotating shaft of the second revolving mechanism was about 4.8 cm. In addition, the distance between the rotating shaft of the second revolving mechanism and the liquid surface in the liquid vessel was set to be about 1.6 cm. Water was contained in the liquid vessel, and in case of water, a pressure difference of 0.98 mbar corresponds to a head difference of 1 cm.

The rotating shaft of the first revolving mechanism is horizontally connected to the electric motor shaft. The oscillation frequency of the rotating shaft of the first revolving mechanism was set to be about 0.5 Hz (or, 30 RPM). Both ends of the microchannel are connected to inlet and outlet tubings, and the liquid vessel is coupled to a liquid vessel tubing which has a larger inner diameter than the tubing and is flexible. The microchannel tubing and the liquid vessel tubing are connected to connection tees of an pressure gauge, and a pressure applied to the microchannel is measured by the pressure gauge. Here, the pressure gauge is connected to a computer so that the change of a pressure difference when the liquid vessel is rotating may be recorded in real time.

In FIG. 11, a solid curve 1100 represents a pressure difference obtained by the above experimental conditions, and a dashed line 1110 represents a square wave exactly calculated. As shown in FIG. 11, the pressure difference obtained through the experiment is approximate to the exact square wave. In addition, the pressure difference obtained through the experiment makes three step changes during 6 sec, which represents that the oscillation frequency is 0.5 Hz. This means that there is nearly no time lag caused by inertial or frictional loss of the rotating disks of the first and second revolving mechanisms, the tubing or the like.

Figure 12:
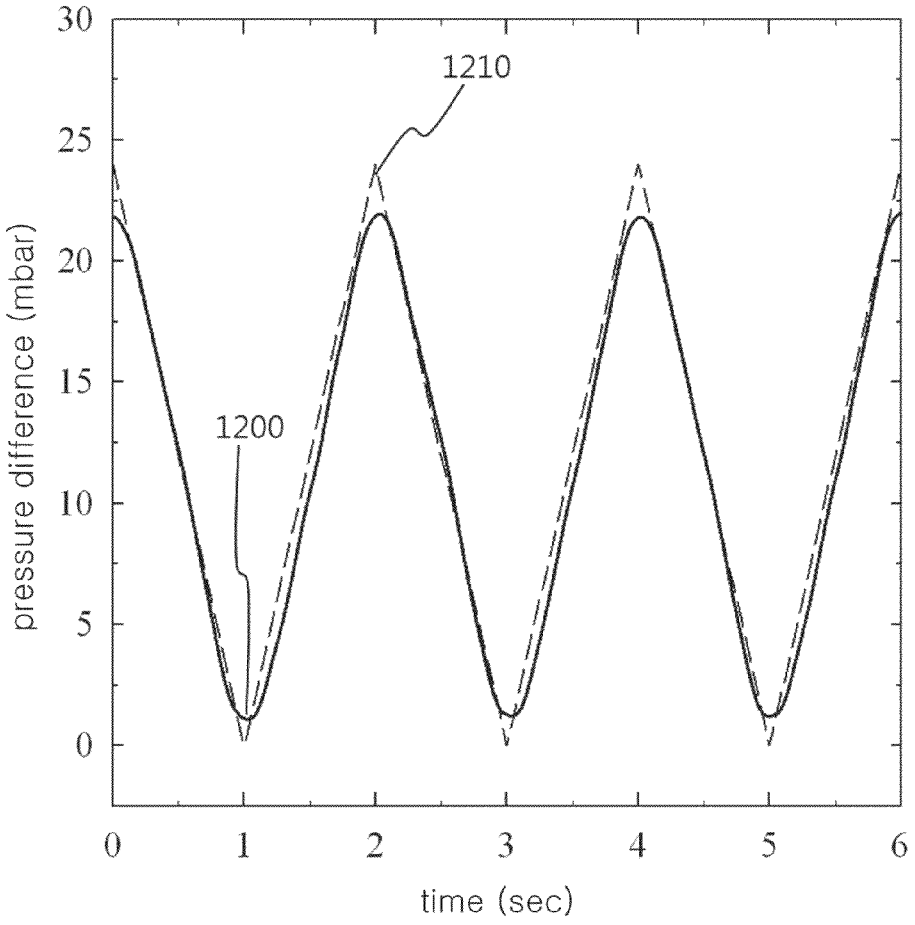
FIG. 12 is a graph showing a pressure change in a microchannel as time passes, in which a triangular wave pulsatile flow with forwarding type is implemented by the apparatus for generating pulsatile flows according to an embodiment.

FIG. 12 is a graph showing a pressure change in a microchannel as time passes, in which a triangular wave pulsatile flow with forwarding type is implemented by the apparatus for generating pulsatile flows according to an embodiment.

The result depicted in FIG. 12 was obtained using the same microchannel as described above with reference to FIG. 11. In addition, the mean pressure difference was set to be three times of the experimental condition described above with reference to FIG. 11, and the amplitude and the period were set to be identical to those described above with reference to FIG. 11. The height difference between the base line and the rotating shaft of the first revolving mechanism was set to be about 12 cm. In addition, based on Equation 7, the distance between the rotating shaft of the first revolving mechanism and the rotating shaft of the second revolving mechanism was set to be about 9.6 cm, and the distance between the rotating shaft of the second revolving mechanism and the liquid surface in the liquid vessel was set to be about 1.2 cm.

In FIG. 12, a solid curve 1200 represents a pressure difference obtained by the above experimental conditions, and a dashed line 1210 represents a triangular wave exactly calculated. As shown in FIG. 12, it is found that the pressure difference obtained in this embodiment is almost identical to the exact triangular wave.

If the apparatus and method for generating pulsatile flows according to the embodiments described above is used, a waveform of a pulsatile flow implemented by controlling a distance ratio between two rotating shafts associated with each other may be adjusted into a square wave or a triangular wave, and the period and amplitude of the wave functional pulsatile flow may respectively controlled by adjusting angular velocity of both rotating shafts, a distance between both rotating shafts or the like. In addition, the mean pressure difference of the pulsatile flow may be changed by adjusting a height difference of the microchannel and the rotating shaft coupled to a motor, and two pulsatile flow patterns, namely a forwarding type and a back-and-forth standing type, may be implemented. The apparatus for generating pulsatile flows according to the embodiments may derive a very accurate result with relatively simple configuration and inexpensive production cost and thus be utilized as a useful device in the microfluidic fields.

Though the present disclosure has been described with reference to the embodiments depicted in the drawings, it is just an example, and it should be understood by those skilled in the art that various modifications and equivalents can be made from the disclosure. However, such modifications should be regarded as being within the scope of the present disclosure. Therefore, the true scope of the present disclosure should be defined by the appended claims.

What is claimed is:

1. An apparatus for generating pulsatile flows, comprising:

a first revolving mechanism configured to rotate based on a first rotating shaft located at a first height from a microchannel;

a second revolving mechanism connected to the first revolving mechanism and configured to rotate based on a second rotating shaft located at a second height different from the first height; and a liquid vessel connected to the second revolving mechanism and configured to contain a liquid to be supplied to the microchannel, wherein by using periodically changing pressure of the liquid applied to the microchannel with revolutions of the first revolving mechanism and the second revolving mechanism, a pulsatile flow is generated in the microchannel by the liquid supplied from the liquid vessel.

2. The apparatus for generating pulsatile flows according to claim 1, wherein a ratio of an angular velocity of the first revolving mechanism and an angular velocity of the second revolving mechanism is determined based on terms of Fourier cosine series representing the pulsatile flow.

3. The apparatus for generating pulsatile flows according to claim 2, wherein the first revolving mechanism is configured to rotate at a first angular velocity, wherein the second revolving mechanism is configured to rotate at a second angular velocity, and wherein the second angular velocity is three times of the first angular velocity.

4. The apparatus for generating pulsatile flows according to claim 1, wherein a ratio of the first height, a distance between the first rotating shaft and the second rotating shaft, and a distance from the second rotating shaft to a surface of a liquid in the liquid vessel is determined based on terms of Fourier cosine series representing the pulsatile flow.

5. The apparatus for generating pulsatile flows according to claim 4, wherein the ratio of the first height, the distance between the first rotating shaft and the second rotating shaft, and the distance from the second rotating shaft to the surface of the liquid in the liquid vessel is 5:6:2.

6. The apparatus for generating pulsatile flows according to claim 4, wherein the ratio of the first height, the distance between the first rotating shaft and the second rotating shaft, and the distance from the second rotating shaft to the surface of the liquid in the liquid vessel is 10:8:1.

7. The apparatus for generating pulsatile flows according to claim 1, wherein the first revolving mechanism includes a first rotating disk perpendicularly coupled to the first rotating shaft, and the second rotating shaft is perpendicularly coupled to the first rotating disk, and wherein the second revolving mechanism includes a second rotating disk coupled to the second rotating shaft and the liquid vessel.

8. The apparatus for generating pulsatile flows according to claim 7, wherein the first rotating disk includes a plurality of assembly points located at different distances from the first rotating shaft, and wherein the second rotating shaft is coupled to any one of the plurality of assembly points.

9. The apparatus for generating pulsatile flows according to claim 8, wherein the plurality of assembly points are arranged to form at least one row of assembly points arranged in a direction from the center of the first rotating disk toward a periphery of the first rotating disk.

10. The apparatus for generating pulsatile flows according to claim 7, wherein the second rotating disk includes a plurality of assembly points located at different points from the second rotating shaft, and wherein the liquid vessel is coupled to any one of the plurality of assembly points.

11. The apparatus for generating pulsatile flows according to claim 7, further comprising:

a balance weight coupled to the first rotating disk;

a balance weight disc connected to the balance weight through the first rotating disk and configured to rotate relative to the first rotating disk due to the center of weight of the balance weight when the first rotating disk is rotating;

a rubber belt connected between the balance weight disc and the second rotating shaft to rotate the second rotating shaft by means of the revolution of the balance weight disc; and a constant tension unit coupled to the first rotating disk to keep the tension of the rubber belt.

12. The apparatus for generating pulsatile flows according to claim 11, wherein a diameter of the balance weight disc is three times of a diameter of a disc of the second rotating shaft connected to the rubber belt.

13. The apparatus for generating pulsatile flows according to claim 11, wherein the sum of weights of the balance weight and the balance weight disc is greater than the sum of weights of the second rotating disk, the second rotating shaft and the liquid vessel.

14. The apparatus for generating pulsatile flows according to claim 1, further comprising a tubing connected between the liquid vessel and the microchannel and configured to carry a liquid, wherein a cross-sectional area of the tubing is larger than a cross-sectional area of the microchannel.

15. The apparatus for generating pulsatile flows according to claim 1, further comprising a pressure gauge connected between the liquid vessel and the microchannel to measure a pressure change in the microchannel.

16. A method for generating pulsatile flows, comprising:

rotating a first revolving mechanism based on a first rotating shaft located at a first height from a microchannel;

rotating a second revolving mechanism, connected to the first revolving mechanism and a liquid vessel containing a liquid, based on a second rotating shaft located at a second height different from the first height; and supplying a liquid from the liquid vessel to the microchannel when the first revolving mechanism and the second revolving mechanism are rotating, thereby generating a pulsatile flow in the microchannel by using periodically changing pressure of the liquid supplied to the microchannel.

17. The method for generating pulsatile flows according to claim 16, wherein a ratio of an angular velocity of the first revolving mechanism and an angular velocity of the second revolving mechanism is determined based on terms of Fourier cosine series representing the pulsatile flow.

18. The method for generating pulsatile flows according to claim 17, wherein said rotating of a first revolving mechanism includes rotating the first revolving mechanism at a first angular velocity, and wherein said rotating of a second revolving mechanism rotates the second revolving mechanism at a second angular velocity which is three times of the first angular velocity.

19. The method for generating pulsatile flows according to claim 16, wherein a ratio of the first height, a distance between the first rotating shaft and the second rotating shaft, and a distance from the second rotating shaft to a surface of the liquid in the liquid vessel is determined based on terms of Fourier cosine series representing the pulsatile flow.

20. The method for generating pulsatile flows according to claim 19, further comprising:

controlling the generated pulsatile flow by adjusting at least one of the first height, the distance between the first rotating shaft and the second rotating shaft, and the distance from the second rotating shaft to the surface of the liquid in the liquid vessel.

21. The method for generating pulsatile flows according to claim 20, wherein said controlling of the generated pulsatile flow includes adjusting at least one of a period, amplitude, mean pressure difference, and waveform of the pulsatile flow.

22. The method for generating pulsatile flows according to claim 19, wherein the ratio of the first height, the distance between the first rotating shaft and the second rotating shaft, and the distance from the second rotating shaft to the surface of the liquid in the liquid vessel is 5:6:2, and wherein said generating of a pulsatile flow includes generating a square wave pulsatile flow.

23. The method for generating pulsatile flows according to claim 22, wherein the first revolving mechanism and the second revolving mechanism are rotated from an initial position where the first rotating shaft is located vertically above a base line, the second rotating shaft is located vertically below the first rotating shaft, and the surface of the liquid in the liquid vessel is located vertically above the second rotating shaft.

24. The method for generating pulsatile flows according to claim 19, wherein the ratio of the first height, the distance between the first rotating shaft and the second rotating shaft, and the distance from the second rotating shaft to the surface of the liquid in the liquid vessel is 10:8:1, and wherein said generating of a pulsatile flow includes generating a triangular wave pulsatile flow.

25. The method for generating pulsatile flows according to claim 24, wherein the first revolving mechanism and the second revolving mechanism are rotated from an initial position where the first rotating shaft is located vertically above a base line, the second rotating shaft is located vertically below the first rotating shaft, and the surface of the liquid in the liquid vessel is located vertically above the second rotating shaft.

26. The method for generating pulsatile flows according to claim 16, wherein said rotating of a second revolving mechanism includes:

connecting a balance weight disc, coupled to the first revolving mechanism and connected to a balance weight through the first revolving mechanism, to the second rotating shaft through a rubber belt;

keeping a tension of the rubber belt by the constant tension unit coupled to the first revolving mechanism;

rotating the balance weight disc relative to the first rotating disk due to a center of weight of the balance weight when the first rotating disk is rotating; and rotating the second rotating shaft by means of the revolution of the balance weight disc.

27. The method for generating pulsatile flows according to claim 16, further comprising:

measuring a pressure change in the microchannel by using a pressure gauge connected between the liquid vessel and the microchannel.

* * * * *